US008919236B2

(12) United States Patent
Bell et al.

(10) Patent No.: US 8,919,236 B2
(45) Date of Patent: Dec. 30, 2014

(54) PERFORATING GUN DROP SUB

(71) Applicants: William T. Bell, Huntsville, TX (US); Don Umphries, New Iberia, LA (US)

(72) Inventors: William T. Bell, Huntsville, TX (US); Don Umphries, New Iberia, LA (US)

( * ) Notice: Subject to any disclaimer, the term of this patent is extended or adjusted under 35 U.S.C. 154(b) by 107 days.

(21) Appl. No.: 13/573,816

(22) Filed: Oct. 9, 2012

(65) Prior Publication Data

US 2014/0096670 A1 Apr. 10, 2014

(51) Int. Cl.
*E21B 43/11* (2006.01)
*E21B 43/116* (2006.01)

(52) U.S. Cl.
CPC ..... *E21B 43/116* (2013.01)
USPC ..... 89/1.15; 166/55; 166/297

(58) Field of Classification Search
CPC ..... E21B 43/117; E21B 23/00; E21B 23/04; E21B 17/06; E21B 29/005
USPC ..... 89/1.15; 102/306, 307, 308, 310; 175/4.6; 166/298, 55.1, 297, 55
See application file for complete search history.

(56) References Cited

U.S. PATENT DOCUMENTS

| | | | | |
|---|---|---|---|---|
| 2,873,675 | A | 2/1959 | Lebourg | |
| 3,706,344 | A | 12/1972 | Vann | |
| 4,040,482 | A | 8/1977 | Vann | |
| 4,526,233 | A | 7/1985 | Stout | |
| 4,776,393 | A | 10/1988 | Forehand et al. | |
| 4,815,540 | A | 3/1989 | Wallbillich, III | |
| 5,293,940 | A | 3/1994 | Hromas et al. | |
| 5,347,929 | A | 9/1994 | Lerche et al. | |
| 5,509,481 | A | 4/1996 | Huber et al. | |
| 5,778,979 | A | 7/1998 | Burleson et al. | |
| 5,992,289 | A * | 11/1999 | George et al. | 89/1.15 |
| 6,098,716 | A | 8/2000 | Hromas et al. | |
| 7,353,871 | B2 | 4/2008 | Hromas et al. | |
| 8,044,820 | B2 * | 10/2011 | Snider et al. | 340/854.8 |
| 8,061,431 | B2 * | 11/2011 | Moore et al. | 166/383 |
| 8,136,439 | B2 * | 3/2012 | Bell | 89/1.15 |
| 8,230,788 | B2 * | 7/2012 | Brooks et al. | 102/202.7 |
| 8,302,523 | B2 * | 11/2012 | Bell | 89/1.15 |
| 2003/0111220 | A1 * | 6/2003 | Bell | 166/55 |
| 2004/0206265 | A1 * | 10/2004 | Bell | 102/347 |
| 2005/0189141 | A1 * | 9/2005 | Bell | 175/4.6 |
| 2006/0075888 | A1 * | 4/2006 | Yang et al. | 89/1.14 |
| 2008/0271887 | A1 * | 11/2008 | Snider et al. | 166/255.1 |
| 2010/0219980 | A1 * | 9/2010 | Snider et al. | 340/854.6 |
| 2011/0088946 | A1 * | 4/2011 | Moore et al. | 175/4.56 |

* cited by examiner

*Primary Examiner* — Bret Hayes
*Assistant Examiner* — Joshua Freeman
(74) *Attorney, Agent, or Firm* — W. Allen Marcontell

(57) ABSTRACT

A perforating gun assembly comprises a drop sub linking the firing head to the gun tube or tubes. The drop sub includes a 360° perimeter shaped charge explosive for severing pipe having an axial bore to accommodate a pass-through of the perforation charge detonation chord. Consequently, the severing tool is detonated by the traverse of a detonation wave along the chord length to disconnect the perforating gun prior to detonation of the perforation charges.

11 Claims, 1 Drawing Sheet

PERFORATING GUN DROP SUB

CROSS-REFERENCE TO RELATED APPLICATION

Not applicable

BACKGROUND OF THE INVENTION

Field of the Invention

The present invention relates to equipment and processes for petroleum well completion and production. In particular, the invention pertains to well perforation equipment and processes for mineral production enhancement.

SUMMARY OF THE INVENTION

Well perforation is a term that is used in the well drilling arts to describe a process of perforating the walls of a fluid mineral production pipe with multiple apertures. Such apertures are clustered in a predetermined pattern within the geologic zone of a fluid mineral bearing strata to facilitate flow of the mineral into the production pipe and up to the surface. The term is also applied to the process of perforating a well casing and cement collar for the same purpose. The well perforation process may also be used to fracture or open a geologic formation along the production face of the well bore wall.

Perforation equipment traditionally includes a length of tube or pipe, called a "perforating gun", having shaped charge explosives set in a helical pattern along the length and around to perimeter of the tube. These shaped charges are designed and aligned to emit a lineally concentrated stream of explosion gas radially from the gun axis. A gun may comprise a multiplicity of such tubes mounted with shaped charges connected in series, end-to-end.

Perforating guns are suspended within a well for placement at the desired downhole perforation position by suspension structure such as a string of tubing or wireline. The gun is secured to the end of the tubing string or wireline.

Traditional perforating gun assembly usually provides a firing head at the upper end. The firing head is a subsection of tube that contains those devices necessary to convert an action or impulse initiated at the well surface into an explosive detonation. Included among such actions is dropping a weight such as a rod for example, along the bore of the suspension pipe or tubing to impact a percussion primer in the firing head. The primer initiates a detonation cord which carries a detonation wave to all of the shaped charges, sequentially. In another case, the firing head may comprise an exploding bridge wire (EBW) or exploding foil initiator (EFI) detonator as described by. U.S. Pat. No. 5,347,429 for example. The EBW or EFI is initiated by an electric pulse carried on an electric conductor integrated with the wireline support structure to initiate the detonation cord.

There are certain circumstances and conditions in the art of deep well drilling for petroleum, under which a perforating gun is disconnected from the supporting wireline or tubing string upon discharge of the perforation charges. When disconnected, the gun is completely severed from any surface linked support and allowed to fall further along the wellbore; usually below the mineral production zone. Often, the depleted gun is abandoned in an extended portion of the wellbore.

The sequence of such a well perforation gun disconnect procedure has, traditionally been perceived in the order of a gun discharge followed by the gun disconnect. However, this sequence has been found to be less than satisfactory due to the consequences of detonation shock when the gun discharges. Prior art disconnect devices have been mechanical latching assemblies subject to structural distortion or destruction caused by detonation shock. Hence, a planned disconnect procedure may not be possible after the gun has discharged.

It is an object of the present invention, therefore, to provide equipment and procedures to disconnect a perforating gun from surface support structure prior to discharge of the explosive perforating charges.

It is also and object of the present invention to provide a disconnect sub between a firing head and gun tube having no mechanical latches or links subject to operational binding or warping.

BRIEF DESCRIPTION OF THE DRAWINGS

The advantages and further features of the invention will be readily appreciated by those of ordinary skill in the art as the same becomes better understood by reference to the following detailed description when considered in conjunction with the accompanying drawings in which like reference characters designate like or similar elements throughout.

DESCRIPTION OF THE PREFERRED EMBODIMENTS

As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate. Moreover, in the specification and appended claims, the terms "pipe", "tube", "tubular", "casing", "liner" and/or "other tubular goods" are to be interpreted and defined generically to mean any and all of such elements without limitation of industry usage.

Figure 1:
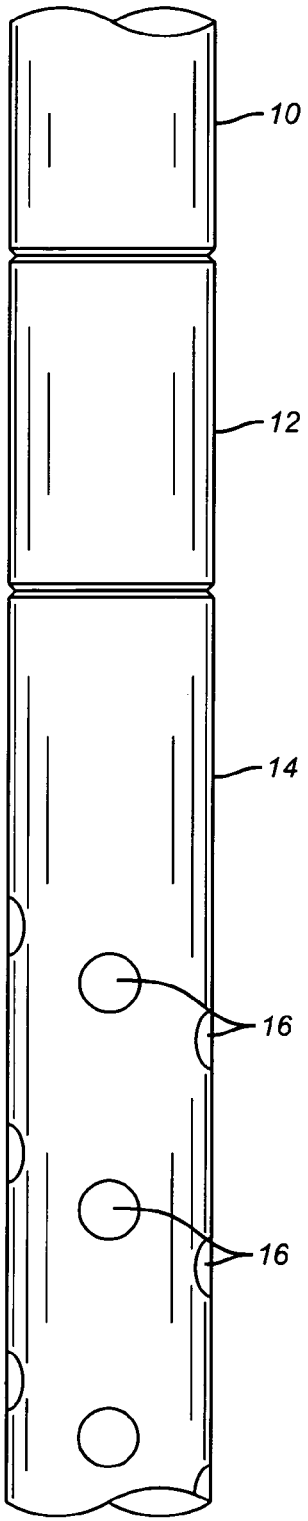
FIG. 1 is a section of perforating gun firing assembly relevant to the present invention.

FIG. 1 represents the essential invention environment showing a partial perforating gun assembly including a firing head 10, a shaped charge pipe cutting sub often interchangeably characterized in the art as a "drop sub" 12 and a perforating gun tube 14. These are independently severable units that may be unitized by integrally threaded box and pin joints. Such an assembly may be suspended into a well bore by wireline, coiled tubing or pipe joints.

In traditional practice, the perforating gun 14 is a tube having a multiplicity of explosive perforating charges 16 set within the tube shell to discharge radially against a production pipe, well casing or raw bore wall. The objective of such perforations is to facilitate the flow of in situ fluids, gas or crude petroleum, from a fluid bearing earth stratum into an inner flow chamber. These explosive charges 16 are often set in a helical pattern around and along the length of the gun tube. While numerous methods have been used to detonate such perforating charges, a continuous detonating cord 28 (FIG. 2) running the length of the gun tube is representative. The cord 28 is connected in proximity to detonation boosters respective to each charge 16 for detonating each of the charges sequentially as the detonation wave carried by the cord progresses along the gun length.

Detonating cord 28 ignition may be initiated from the surface by a percussion primer or by an exploding bridge wire (EBW) exploding foil initiator (EFI), for example. In the case of the percussion detonator, a percussion weight is dropped into a gun supporting coiled tube or pipe string. The percussion weight falls along the tubing bore to impact a percussion detonator. In the case of an EBW or EFI, an electric pulse is transmitted by wireline conduit to initiate the detonation. The conduit is often integrated into the windings of a wireline support string.

Figure 2:
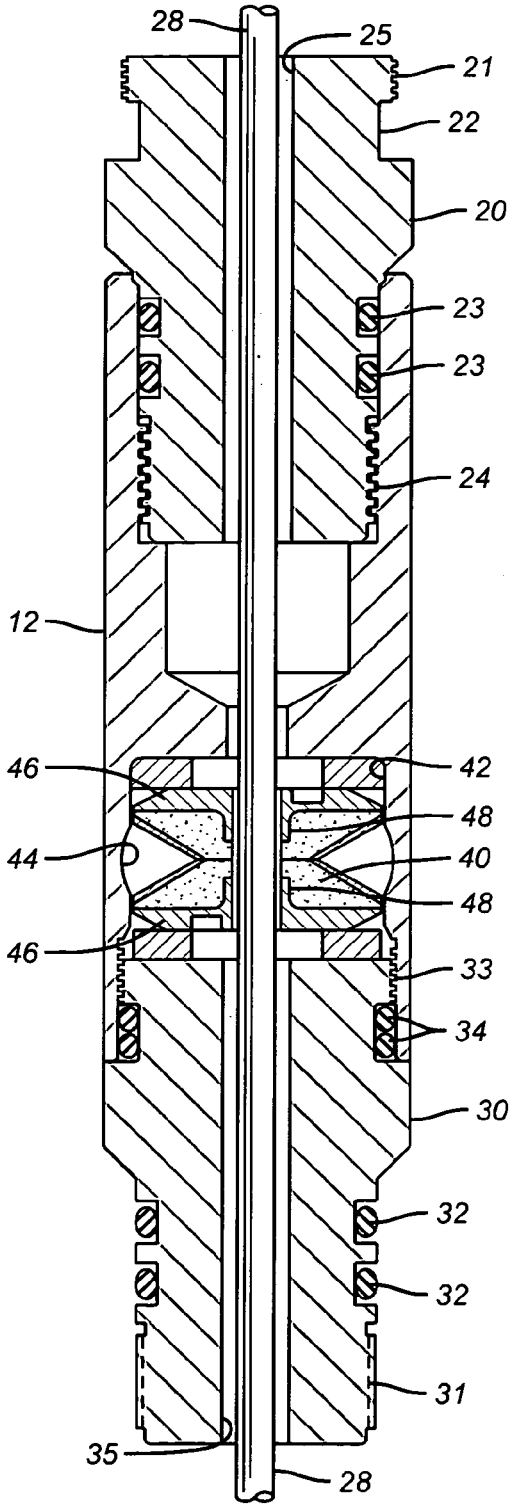
FIG. 2 is a cross-sectional detail of the present drop sub.

With respect to FIG. 2, the drop sub 12 comprises a tubular housing having box threads 24 at one distal end to receive meshing assembly pin threads on a firing head connector 20. O-rings 23 seal the threaded connector joint from moisture invasion. Pin threads 21 secure the connector 20 to the firing head 10. Firing head O-rings (not shown) seal against the sealing groove 22. A bore 25 along the connector 20 axis accommodates detonating cord 28.

A gun connector 30 is secured to the opposite end of the drop sub housing by assembly pin threads 33 meshing with box threads in the drop sub housing. O-rings 34 seal this joint from moisture invasion. Threads 31 secure the gun 14 to the connector 30 with an O-ring moisture seal 32. A bore 35 along the connector 30 axis facilitates continuity of the detonation cord 28 through the gun connector 30 into the gun 14.

A chamber 42 in the drop sub 12 receives a shaped charge tubing cutter 40 in alignment with a cutting window 44 to provide an explosive cutting plane that is substantially transverse of the housing. The cutting window 44 is a reduced thickness section of pipe wall annulus.

The tubing cutter explosive 40 is compressed between top and bottom end plates having an axial aperture to accommodate the detonating cord 28. Between the end plate bosses 48, the cutter explosive 40 is in direct face exposure to the detonating cord 28.

When the gun 14 is located at a desired position along the wellbore, an initiating event is performed to begin the detonation sequence by activating the firing head 10. The firing head 10 ignites the detonation cord.

As a detonation wave travels the cord 28 length, the tube cutting charge 40 is discharged first thereby severing the gun 14 from the firing head 10 and any connection with the surface. However, the detonation wave continues along its length through the gun, detonating the perforation charges 16 along the way.

The detonation wave traverses the length of cord 28 in a few microseconds. However, the gravity driven acceleration of the gun 14, comparatively, is much slower. Hence, although the structural link 12 between the gun and any up-hole support from the firing head has been severed, the perforation charges will have discharged and performed their intended function before any significant gun movement.

Although the invention disclosed herein has been described in terms of specified and presently preferred embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

The invention claimed is:

1. A method of detonating perforation charges in a well perforation gun comprising the steps of:

combining a serially aligned assembly including a detonation cord, a firing head, a shaped charge pipe cutting sub having a tube cutting explosive enclosed within a housing and a perforating gun;

connecting said cutting sub housing to said firing head and to said perforating gun to unitize said assembly;

providing an aperture through said tube cutting explosive along an axis thereof;

providing a plurality of shaped charge perforating explosives along a length of said perforating gun;

threading said detonation cord from said firing head through said tube cutting explosive aperture;

continuing said detonation cord from said tube cutting explosive aperture along the length of said perforating gun in sequential detonation proximity with said perforating explosives;

positioning said assembly at a predetermined location within a well bore;

activating said firing head to initiate a detonation wave along said detonation cord;

detonating said tube cutting explosive by said detonation wave to sever said assembly by cutting said housing; and, detonating perforating charges within said perforation gun by said detonation wave after severance of said assembly.

2. A perforating gun assembly comprising the combination of a firing head, a drop sub, a perforating gun and an elongated detonation cord, said firing head comprising means for igniting said detonation cord at one end thereof; said perforating gun comprising an elongated tube having a multiplicity of explosive perforating charges distributed along a tubular wall thereof; said drop sub comprising a housing section structurally securing a connection between said firing head and said perforation gun and enclosing an explosive cutting charge aligned to separate said perforating gun from said firing head by severing said housing section upon detonation; said elongated detonation cord threaded from said firing head, through an axial aperture in said cutting charge in detonation proximity to cutting charge explosive and along said perforating gun subsequent to perforating gun separation from said firing head and in sequential detonation proximity with said perforating charges.

3. A perforating gun assembly as described by claim 2 wherein said means for igniting said detonation cord includes a percussion primer.

4. A perforating gun assembly as described by claim 2 wherein said means for igniting said detonation cord includes an exploding bridge wire.

5. A perforating gun assembly as described by claim 2 wherein said means for igniting said detonation cord includes an exploding foil initiator.

6. A perforating gun assembly as described by claim 2 wherein said drop sub housing section further comprises a pipe wall of reduced wall thickness surrounding said cutting charge explosive.

7. A release apparatus for physically separating a well perforating gun from downhole suspension structure, said apparatus comprising a perforating gun having a multiplicity of explosive, well perforating charges distributed along a length of said gun, an upper end of said gun secured to a lower end of a drop sub housing, an upper end of said drop sub housing secured to a lower end of a detonation cord firing head, said firing head having an upper end secured to downhole suspension structure; said drop sub having an explosive cutting charge positioned therein having an explosive cutting plane aligned transversely of a housing axis, said cutting charge having a detonation cord aperture therein; and, a detonation cord operatively secured at one end thereof to said firing head, extended through said cutting charge aperture and continuing along said perforating gun to carry a detonation wave for severing said housing to separate said perforating gun from said firing head prior to detonating said well perforating charges.

8. A release apparatus as described by claim 7 wherein said explosive cutting charge is aligned within a housing window having a surrounding tube wall of reduced wall thickness.

9. A release apparatus as described by claim 7 wherein said firing head comprises a percussion primer for igniting said detonation cord.

10. A release apparatus as described by claim 7 wherein said firing head comprises an exploding foil initiator for igniting said detonation cord.

11. A release apparatus as described by claim 7 wherein said firing head comprises an exploding bridge wire for igniting said detonation cord.

* * * * *